US008858255B2

(12) United States Patent
Boutin et al.

(10) Patent No.: US 8,858,255 B2
(45) Date of Patent: Oct. 14, 2014

(54) MAGNETIC SCREW GUIDE FOR DISTRIBUTION BLOCK ASSEMBLY

(71) Applicant: Hubbell Incorporated, Shelton, CT (US)

(72) Inventors: Kris Robin Boutin, Mont Vernon, NH (US); Evan Ronald Martin, Derry, NH (US)

(73) Assignee: Hubbell Incorporated, Shelton, CT (US)

( * ) Notice: Subject to any disclaimer, the term of this patent is extended or adjusted under 35 U.S.C. 154(b) by 34 days.

(21) Appl. No.: 13/789,818

(22) Filed: Mar. 8, 2013

(65) Prior Publication Data

US 2014/0256177 A1 Sep. 11, 2014

(51) Int. Cl.
*H01R 13/60* (2006.01)
*H01R 43/00* (2006.01)
*H01R 33/945* (2006.01)

(52) U.S. Cl.
CPC ..... *H01R 33/9453* (2013.01); *H01R 43/00* (2013.01)
USPC ..... 439/527

(58) Field of Classification Search
USPC ..... 439/527, 801, 810, 813, 38–40, 709
See application file for complete search history.

(56) References Cited

U.S. PATENT DOCUMENTS

| | | | | |
|---|---|---|---|---|
| 2,641,290 | A | 6/1953 | Webb | |
| 5,376,024 | A * | 12/1994 | Sako et al. | 439/813 |
| 5,501,611 | A * | 3/1996 | Staiger et al. | 439/404 |
| 7,025,597 | B1 * | 4/2006 | Chang | 439/39 |
| 7,052,333 | B2 | 5/2006 | Siracki et al. | |
| 7,107,882 | B1 | 9/2006 | Chang | |
| 2005/0155211 | A1 | 7/2005 | Powell | |
| 2006/0128232 | A1 * | 6/2006 | Kim | 439/813 |
| 2007/0059992 | A1 * | 3/2007 | Kim | 439/810 |
| 2009/0288525 | A1 | 11/2009 | Chen | |

FOREIGN PATENT DOCUMENTS

JP 8001533 A 1/1996

* cited by examiner

*Primary Examiner* — Edwin A. Leon
(74) *Attorney, Agent, or Firm* — Mark S. Bicks; Alfred N. Goodman

(57) ABSTRACT

A distribution block assembly includes a base and a cover removably connected to the base. A first opening in the base receives a conductor and a second opening in the base removably receives a fastener to secure the conductor received in the first opening. A tab extends from the cover toward the base. A magnetic member is connected to the tab to releasably secure a fastener when the fastener is not disposed in the second opening. The magnetic member prevents movement and loss of the fastener when removed from the second opening.

20 Claims, 6 Drawing Sheets

MAGNETIC SCREW GUIDE FOR DISTRIBUTION BLOCK ASSEMBLY

FIELD OF THE INVENTION

The present invention relates generally to a magnetic screw guide for a distribution block assembly. More particularly, the present invention relates to a distribution block assembly having a tab disposed adjacent a fastener opening and a magnetic member connected to the tab to securely retain a fastener not disposed in the fastener opening. Still more particularly, the present invention relates to a cover having a tab and a magnetic member connected to the tab, and a base to which the cover is removably connected such that the magnetic member is disposed adjacent a fastener opening in the base when the cover is connected to the base.

BACKGROUND OF THE INVENTION

In the electrical utilities industry, distribution blocks are typically used as a connection point between several conductors. The conductors are inserted in openings in a base. Set screws are used to secure the conductors inserted in the base to prevent their accidental removal.

However, one disadvantage associated with the distribution blocks is preventing loss of the set screws. The distribution blocks are often installed in confined spaces such that accessing the distribution block to install a set screw can be difficult. Additionally, set screws are easily dropped and lost when removed to remove an inserted conductor. Such actions result in additional time being required to complete installation projects. Accordingly, a need exists for a distribution block assembly that substantially prevents loss of a fastener used to secure a conductor thereto.

Another disadvantage associated with the distribution blocks is the difficulty of installing a set screw in a confined area. In addition to having difficulty accessing a distribution block, manipulating the set screw when securing a conductor can be problematic. Movement of the set screw during installation can result in loss of the set screw, thereby preventing installation of the conductor. Installation is delayed while obtaining a replacement set screw, in addition to the time required to accomplish the cumbersome task of installing the set screws in the distribution block. Accordingly, a need exists for a distribution block assembly that facilitates installation of fasteners therein.

SUMMARY OF THE INVENTION

An object of the present invention is to provide a distribution block assembly that prevents loss of a fastener that secures a conductor to the distribution block assembly.

Another object of the present invention is to provide a distribution block assembly having a magnetic member that secures a fastener thereto when the fastener is removed from an opening.

Another object of the present invention is to provide a distribution block assembly having a transparent cover to facilitate viewing the fasteners during installation of conductors in the distribution block assembly.

Still another object of the present invention is to provide a distribution block assembly having a tool opening in a cover aligned with a fastener opening in a base such that a fastener can be disposed in the fastener opening without removing the cover from the base.

The foregoing objects are basically attained by a distribution block assembly including a base and a cover removably connected to the base. A first opening in the base receives a conductor and a second opening in the base removably receives a fastener to secure the conductor received in the first opening. A tab extends from the cover toward the base. A magnetic member is connected to the tab to secure a fastener thereto when the fastener is not disposed in the second opening. The magnetic member prevents movement and loss of the fastener when removed from the second opening.

The foregoing objects are also basically attained by a method of securing a fastener to a magnetic member of a cover of a distribution block assembly. The cover is connected to a base of the distribution block assembly. A conductor is inserted in a first opening in the base. The fastener is connected to a second opening in the base by passing a tool through a third opening in the cover to secure the fastener in the second opening, thereby securing the conductor to the distribution block assembly.

Objects, advantages, and salient features of the invention will become apparent from the following detailed description, which, taken in conjunction with the annexed drawings, discloses an exemplary embodiment of the present invention.

As used in this application, the terms "front," "rear," "upper," "lower," "upwardly," "downwardly," and other orientational descriptors are intended to facilitate the description of the exemplary embodiment of the present invention, and are not intended to limit the structure thereof to any particular position or orientation.

BRIEF DESCRIPTION OF THE DRAWINGS

The above benefits and other advantages of the various embodiments of the present invention will be more apparent from the following detailed description of exemplary embodiments of the present invention and from the accompanying drawing figures, in which.

Throughout the drawings, like reference numerals will be understood to refer to like parts, components and structures.

DETAILED DESCRIPTION OF EXEMPLARY EMBODIMENT

Figure 1:
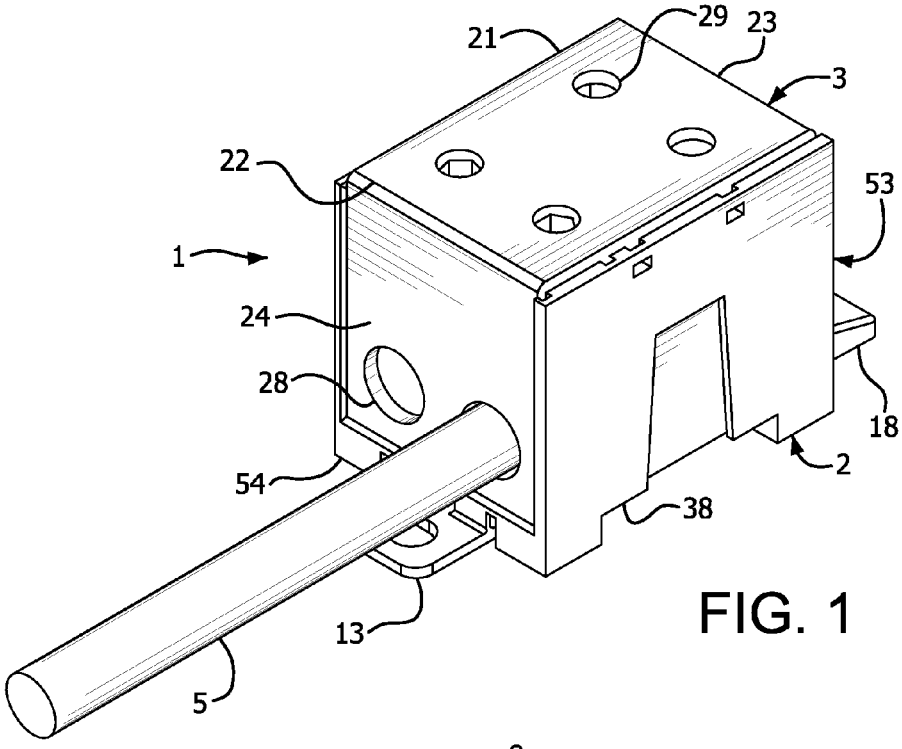
FIG. 1 is a perspective view of a distribution block assembly in accordance with an exemplary embodiment of the present invention receiving a conductor.
Figure 2:
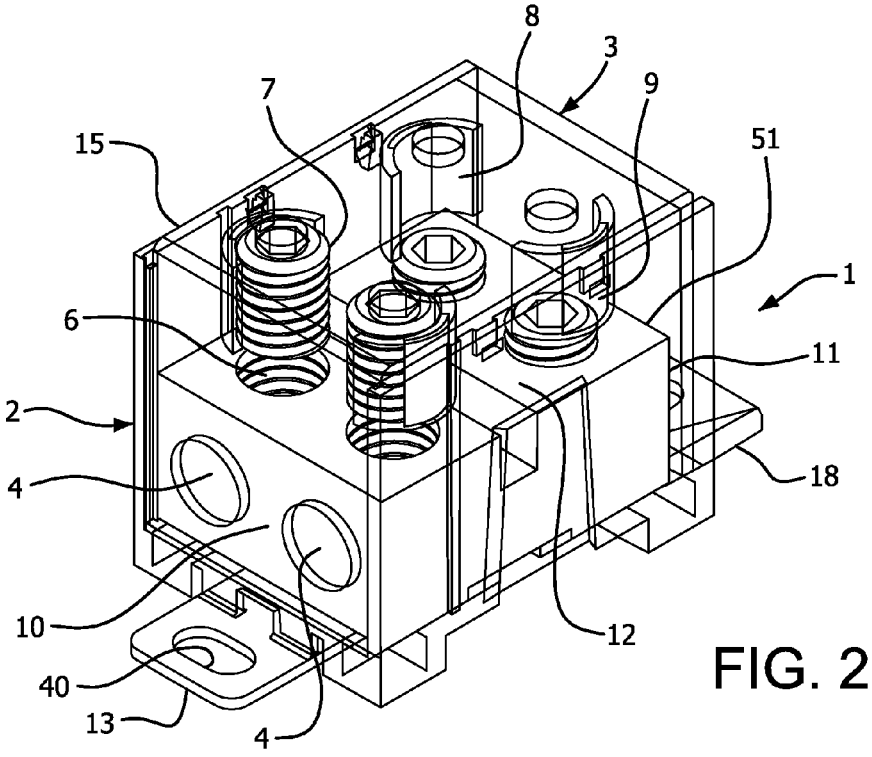
FIG. 2 is a perspective view of the distribution block assembly of FIG. 1 in partial cross-section prior to receiving the conductor.

In an exemplary embodiment of the present invention shown in FIGS. 1-12, a distribution block assembly 1 includes a base 2 and a cover 3 removably connected to the base 2. A first opening 4 in the base 2 receives a conductor 5 and a second opening 6 in the base 2 removably and threadably receives a fastener 7 to secure the received conductor 5. A tab 8 extends downwardly from the cover 3. A magnetic member 9 is connected to the tab 8 to secure the fastener 7 releasably thereto when the fastener is not disposed in the second opening 6. The magnetic member 9 prevents movement and loss of the fastener 7 when removed from the second opening 6, as shown in FIG. 2.

Figure 3:
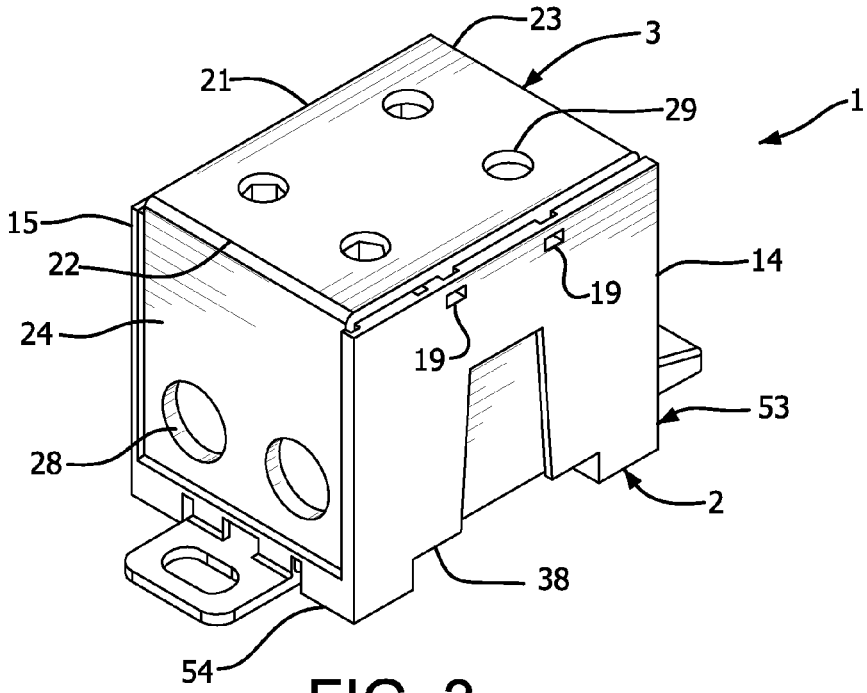
FIG. 3 is a perspective view of the distribution block assembly of FIG. 2 without the conductor.
Figure 4:
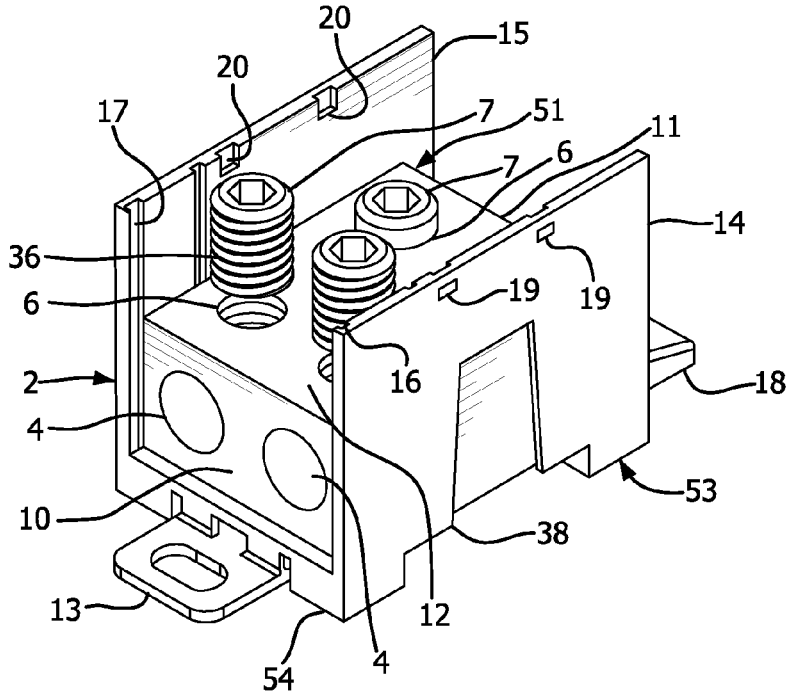
FIG. 4 is a perspective view of the distribution block assembly of FIG. 3 with the cover removed.
Figure 5:
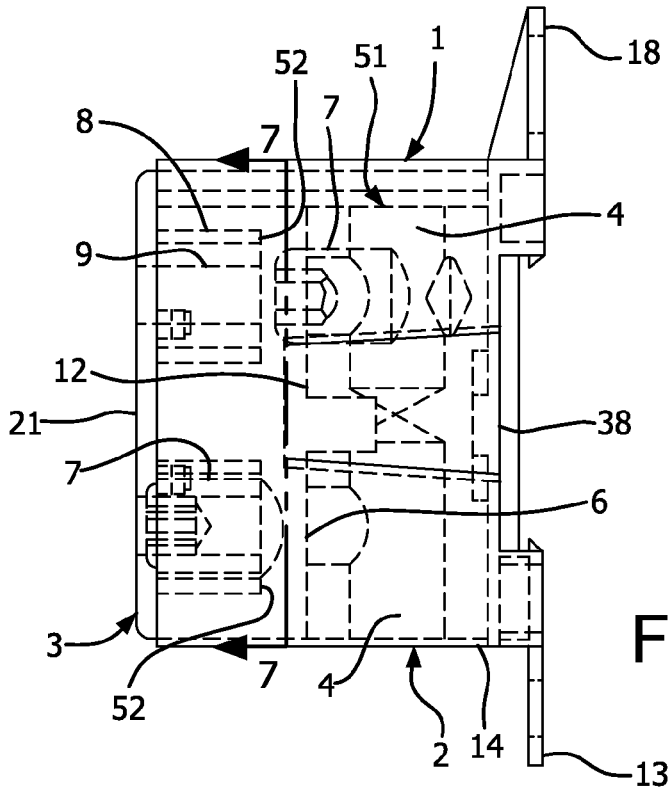
FIG. 5 is a side elevational view of the distribution block assembly of FIG. 3.

The base 2, as shown in FIGS. 1, 3 and 4, has first and second oppositely disposed side walls 14 and 15. The base 2 includes a housing 53 and a block member 51 disposed therein, as shown in FIGS. 2, 4 and 5.

The block member 51 has the first opening 4 for receiving the conductor 5 disposed in a front surface 10 thereof, as shown in FIG. 4. Preferably, the front surface 10 of the aluminum block 51 has two first openings 4. A rear surface 11 of the block member 51 is oppositely disposed from the front surface 10 and preferably includes two first openings. The front and rear surfaces 10 and 11 of the block member 51 can have any suitable number of first openings 4.

Figure 8:
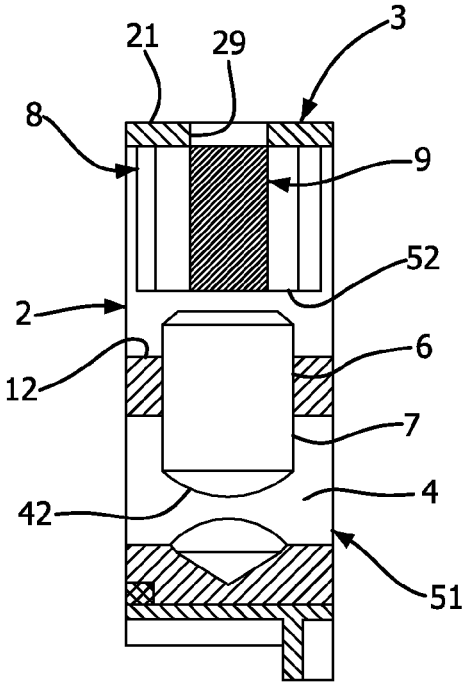
FIG. 8 is a side elevational view in partial cross-section of the cover of the distribution block assembly taken along line 8-8 of FIG. 6.

An upper surface 12 extends between the front and rear surfaces 10 and 11 of the block member 51, as shown in FIGS. 2 and 4. The upper surface 12 of the block member 51 has a second opening 6 therein extending substantially perpendicularly to a direction in which the first opening 4 extends, as shown in FIGS. 5 and 8. The second opening 6 is internally threaded and communicates with the first opening 4 such that the externally threaded fastener 7 inserted and threaded in the second opening 6 engages the conductor 5 inserted in the first opening 4. Preferably, four second openings 6 are disposed in the upper surface 12. Each second opening 6 communicates with a different first opening 4 such that each inserted fastener 7 engages a different conductor 5.

The housing 53 is preferably substantially U-shaped and has first and second side walls 14 and 15 extending upwardly from a base wall 54, as shown in FIGS. 1, 3 and 4. Preferably, the first and second side walls 14 and 15 extend beyond the front and rear surfaces 10 and 11, as shown in FIG. 4. Grooves 16 and 17 are formed in the first and second side walls 14 and 15, respectively. The grooves 16 and 17 extend in a direction substantially parallel to a longitudinal axis of the second openings 6. Openings 19 and 20 are disposed in the first and second side walls 14 and 15, respectively. Mounting tabs 13 and 18 extend outwardly from the front and rear surfaces 10 and 11 and have openings 40 and 41 (FIG. 6) therein to facilitate securing the distribution box assembly 1 to a support.

Figure 9:
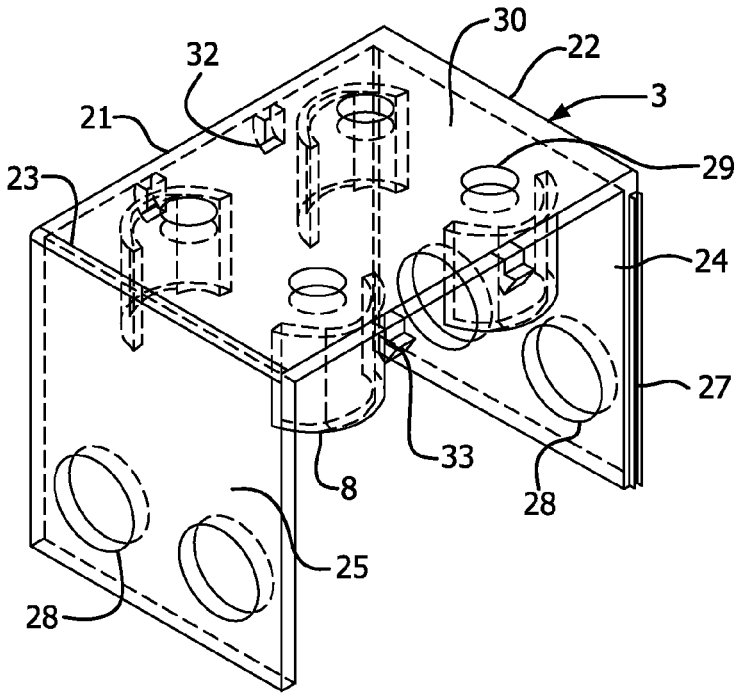
FIG. 9 is a perspective view of the cover of the distribution block assembly of FIG. 3.
Figure 10:
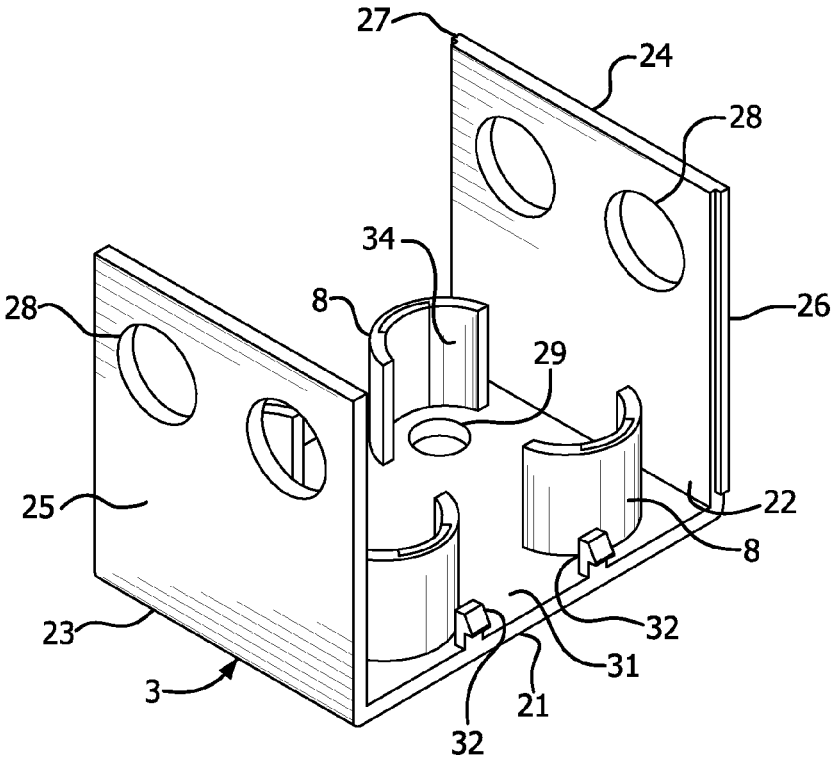
FIG. 10 is a lower perspective view of the cover of the distribution block assembly of FIG. 3.
Figure 11:
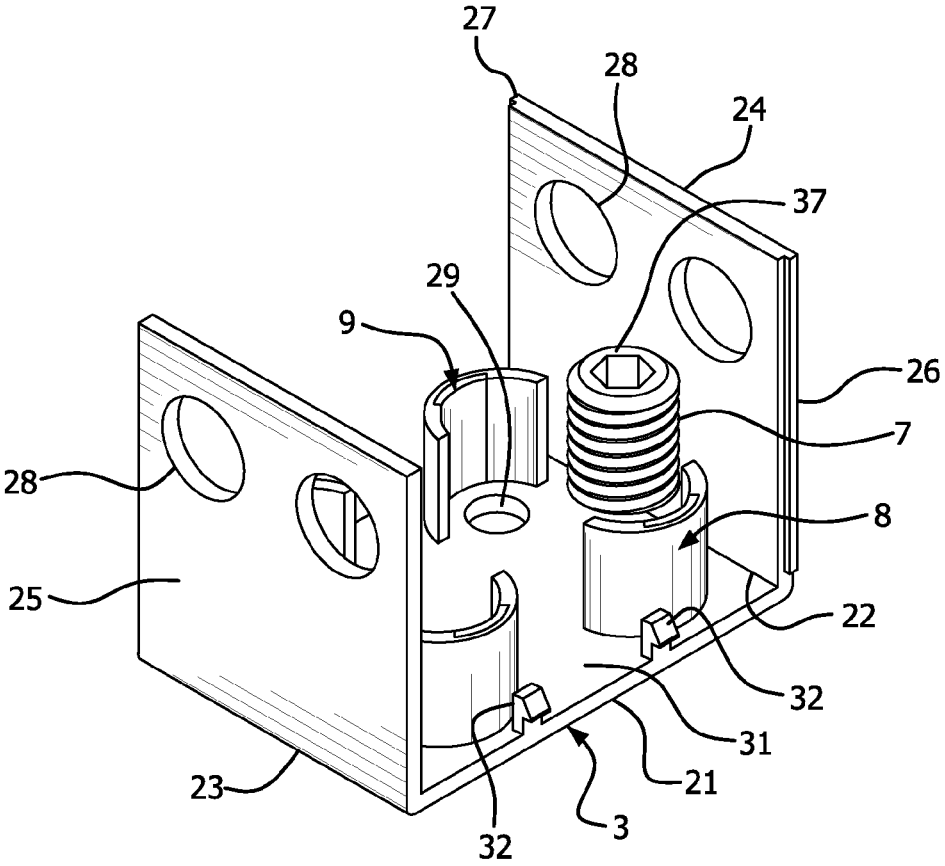
FIG. 11 is a lower perspective view of the cover of FIG. 10 about to receive a fastener.
Figure 12:
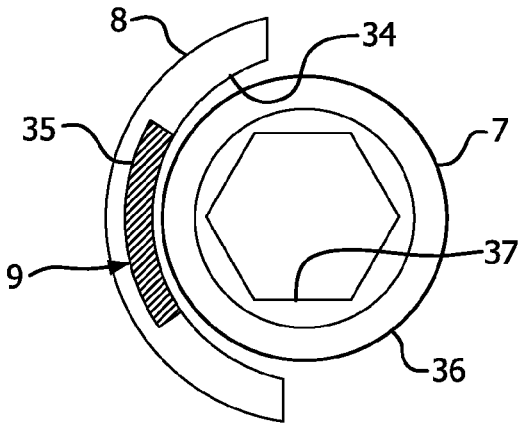
FIG. 12 is an enlarged top plan view of the tab and magnetic member of the cover of FIG. 11.

The cover 3 has a base wall 21 having first and second ends 22 and 23, as shown in FIGS. 1 and 3. A first end wall 24 extends substantially perpendicularly to the base wall 21 from the first end 22. A second end wall 25 extends substantially perpendicularly to the base wall 21 from the second end 23, as shown in FIGS. 9-11. Preferably, the cover 3 is substantially U-shaped. Ribs 26 and 27 extend outwardly from opposite edges of the first end wall 24. An opening 28 is disposed in each of the first and second end walls 24 and 25. Preferably, two openings 28 are disposed in each of the first and second end walls 24 and 25.

An opening 29 is disposed in the base wall 21 of the cover 3 and is adapted to receive a tool therethrough. Preferably, four tool openings 29 are disposed in the base wall 21, as shown in FIGS. 1 and 3. The tool openings 29 extend from an outer surface 30 to an inner surface 31 of the base wall 21. Latches 32 and 33 extend downwardly from the inner surface 31 on opposite free sides of the base wall 21 and engage the openings 19 and 20 in the side walls 14 and 15 of the base 2. Preferably, two latches 32 and 33 are disposed on each of the free sides of the base wall 21.

The tab 8 extends downwardly from an inner surface 31 of the base wall, as shown in FIGS. 9-11. The tab 8 preferably has a substantially semi-cylindrical shape. A recess 35 in an inner surface 35 receives the magnetic member 9. The concave inner surface 34 of the tab 8 faces the tool opening 29 such that the magnetic member 9 is disposed adjacent the tool opening 29. The magnetic member 9 preferably has a shape corresponding to the recess 35 in the tab 8. The magnetic member 9 is preferably secured to the tab 8 with an adhesive, although any suitable means of securing the magnetic member 9 to the tab 8 can be used.

The fastener 7 has an outer surface 36 that is preferably threaded, as shown in FIGS. 2 and 4. A socket 37 at one end of the fastener 7 receives a tool to install the fastener in the fastener opening 6 in the base 2. Preferably, the socket 37 is hexagonal to receive a tool, such as an alien key.

Figure 6:
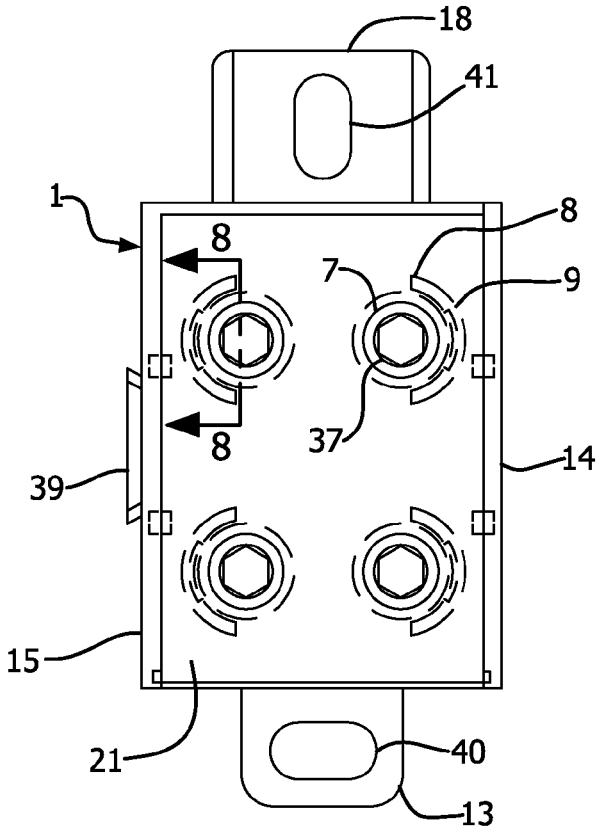
FIG. 6 is a front elevational view of the distribution block assembly of FIG. 3.
Figure 7:
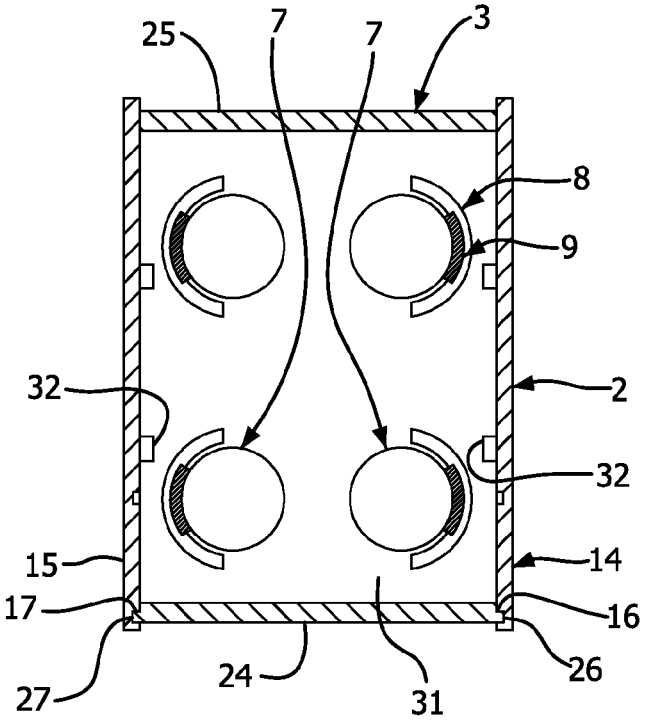
FIG. 7 is a front elevational view in partial cross-section of a cover of the distribution block assembly taken along line 7-7 of FIG. 5.

A cutout 38 is formed in the first side wall 14 of the base 2, as shown in FIGS. 3 and 4. A corresponding projection 39 extends outwardly from the second side wall 15, as shown in FIG. 6. The projection 39 is received by a cutout 38 in an adjacent distribution block assembly 1 to facilitate mounting a plurality of distribution block assemblies 1 side-by-side.

The housing 53 is preferably made of plastic and unitarily formed as a single member. The block member 51 is preferably made of a conductive material, such as aluminum. The block member 51 is connected to the housing 53 in any suitable manner to form the base 2, such as molding the block member 51 into the housing 53 or press fitting the block member to the housing.

The cover 3 is preferably unitarily formed as a single member. Preferably, the cover 3 is made of plastic.

To assemble the distribution block assembly 1, the cover 3 is connected to the base 2, as shown in FIG. 3. Prior to connecting the cover 3 to the base 2, fasteners 7 are connected to the magnetic members 9 of the tabs 8, as shown in FIG. 5. The fasteners 7 are secured to the magnetic members 9 such that the sockets 37 are aligned with the openings 29 in the cover 3, as shown in FIG. 8.

The cover 3 is then aligned with the base 2 such that the ribs 26 and 27 of the cover engage the grooves 16 and 17 of the base 2. The ribs 26 and 27 sliding in the grooves 16 and 17 guides movement of the cover 3 as the cover is pushed downwardly onto the base 2. The cover 3 is pushed downwardly until the latches 32 snap into the openings 19 and 20 in the first and second side walls 14 and 15 of the housing 53 of the base 2, thereby securing the cover 3 to the base 2. The latches 32 can be pushed out of the openings 19 and 20 to remove the cover from the base 2. The fasteners 7 are secured within the distribution box assembly 1 by the magnetic members 9. Free ends 52 of the tabs 8 are spaced from the upper surface 12 of the block member 51 of the base 2, as shown in FIG. 5 when the cover 3 is connected to the base 2.

The openings 28 in the cover 3 are aligned with the first openings 4 in the block member 51 of the base 2 when the cover 3 is connected to the base 2, as shown in FIGS. 1-3, such that a conductor 5 can be inserted therethrough. The second openings 6 in the block member 51 of the base 2 are aligned with the tool openings 29 in the cover 3 such that the fasteners 7 can be moved from a removed position secured to the magnetic members 9 to an installed position received in the second openings 6 in the base 2, as shown in FIGS. 2 and 5. The magnetic members 9 secure the fasteners 7 such that the fasteners 7 are aligned with the second openings 6 in the block member 51 when the cover 3 is connected to the base 2.

The first and second side walls 14 and 15 of the housing 53 of the base 2 and the first and second end walls 24 and 25 of the cover 3 prevent accessing the fasteners 7 except through the tool openings 29 in the base wall 21 of the cover 3. The tool is inserted through the opening 29 in the base wall 21 of the cover 3 to engage the socket 37 in the fastener 7. The tool is rotated to thread the fastener 7 into the second opening 6 until a second end 42 (FIG. 8) of the fastener engages the conductor 5 inserted in the first opening 4 in the block member 51 of the base 2. The tool can be inserted through the opening 29 to engage the socket 37 of the fastener 7 to withdraw the fastener from the second opening 6 such that the conductor 5 can be removed. The fastener 7 can be withdrawn from the second opening 6 until the fastener is secured to the magnetic member 9, as shown in FIGS. 2 and 5. The arcuate shape of the inner surfaces 34 of the tabs 8 guide the fasteners 7 as the fasteners are installed in and withdrawn from the second openings 6 in the base. The preferably transparent cover 3 further facilitates installing and withdrawing the fasteners 7.

The magnetic member 9 is of a sufficient strength to prevent accidental removal of the fastener 7 therefrom, but not to interfere with installation of the fastener 7 when engaged by the tool. Accordingly, the magnetic members 9 securely retain the fasteners 7 in the distribution block assembly 1 such the fasteners 7 do not fall out of the distribution box assembly and retain the fasteners in alignment with the second openings 6 in the base 2 to facilitate easy installation.

The foregoing embodiment and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. A distribution block assembly, comprising:

a fastener;

a base having a first opening to receive a conductor and a second opening to removably receive said fastener to secure the conductor received in said first opening;

a cover removably connected to said base;

a tab extending from said cover toward said base; and a magnetic member connected to said tab to secure said fastener thereto when said fastener is not disposed in said second opening.

2. The distribution block assembly according to claim 1, wherein said tab is unitarily formed as a single piece with said cover.

3. The distribution block assembly according to claim 1, wherein an adhesive connects said magnetic member to said tab.

4. The distribution block assembly according to claim 1, wherein said cover is transparent.

5. The distribution block assembly according to claim 1, wherein a third opening in said cover is aligned with said first opening in said base to receive the conductor.

6. The distribution block assembly according to claim 4, wherein a fourth opening in said cover is aligned with said second opening in said base to receive a tool therethrough to install said fastener in said second opening.

7. The distribution block assembly according to claim 1, wherein a latch connected to said cover engages said base to secure said cover to said base.

8. The distribution block assembly according to claim 1, wherein said tab has a substantially semi-cylindrical shape.

9. The distribution block assembly according to claim 1, wherein said cover has a rib engaging a groove in said base to facilitate aligning said cover with said base.

10. The distribution block assembly according to claim 1, wherein said tab has a recess for receiving said magnetic member.

11. The distribution block assembly according to claim 10, wherein an outer surface of said magnetic member is flush with an inner surface of said tab.

12. The distribution block assembly according to claim 1, wherein a free end of said tab is spaced from said second opening when said cover is connected to said base.

13. The distribution block assembly according to claim 1, wherein said cover is substantially U-shaped.

14. The distribution block assembly according to claim 1, wherein said cover is made of plastic.

15. The distribution block assembly according to claim 1, wherein said base includes a conductive block member connected to a housing.

16. The distribution block assembly according to claim 15, wherein said first and second openings are formed in said conductive block member.

17. A method of securing conductors to a distribution block assembly, comprising the steps of securing a fastener to a magnetic member of a cover of the distribution block assembly;

connecting the cover to a base of the distribution block assembly;

inserting a conductor in a first opening in the base; and connecting the fastener to a second opening in the base by passing a tool through a third opening in the cover to secure the fastener in the second opening, thereby securing the conductor to the distribution block assembly.

18. The method of securing conductors to a distribution block assembly according to claim 17, wherein the connecting the fastener step is performed with the cover connected to the base.

19. The method of securing conductors to a distribution block assembly according to claim 17, wherein removing the fastener from the second opening in the base by passing the tool through the third opening in the cover; and securing the fastener to the magnetic member.

20. The method of securing conductors to a distribution block assembly according to claim 19, wherein the removing the fastener step is performed with the cover connected to the base.

* * * * *